United States Patent [19]

Sire et al.

[11] Patent Number: 4,877,413

[45] Date of Patent: Oct. 31, 1989

[54] PROCESS FOR THE END-TO-END DYEING OF CELLULOSIC FIBRES

[75] Inventors: Jean-Marie Sire, Hégenheim, France; Peter Scheibli, Bottmingen, Switzerland

[73] Assignee: Ciba-Geigy Corporation, Ardsley, N.Y.

[21] Appl. No.: 30,188

[22] Filed: Mar. 26, 1987

[30] Foreign Application Priority Data

Apr. 7, 1986 [CH] Switzerland ..... 1347/86

[51] Int. Cl.[4] ..... C09B 62/00; D06M 13/34

[52] U.S. Cl. ..... 8/543; 8/189; 8/190

[58] Field of Search ..... 8/543, 189, 190

[56] References Cited

U.S. PATENT DOCUMENTS

| | | | |
|---|---|---|---|
| 2,928,711 | 3/1960 | Denyer et al. | 8/29 |
| 3,400,121 | 9/1968 | Weckler et al. | 260/239.7 |
| 4,180,664 | 12/1979 | Perrin et al. | 544/194 |
| 4,246,670 | 1/1981 | Perrin et al. | 260/239.7 |
| 4,300,903 | 11/1981 | Engelhardt et al. | 8/531 |
| 4,504,272 | 3/1985 | Ong | 8/543 |

FOREIGN PATENT DOCUMENTS

| | | |
|---|---|---|
| 1059399 | 6/1959 | Fed. Rep. of Germany . |
| 1147191 | 4/1963 | Fed. Rep. of Germany . |
| 482345 | 3/1938 | United Kingdom . |
| 884158 | 12/1961 | United Kingdom . |
| 1301402 | 8/1972 | United Kingdom . |
| 1318879 | 5/1973 | United Kingdom . |

OTHER PUBLICATIONS

CA 82:172505c Yasuda et al., (1975).
CA 102:80212h Sumitomo, (1985).
CA 100:158175d Gunze, (1984).

*Primary Examiner*—John F. Niebling
*Assistant Examiner*—Isabelle Rodriguez
*Attorney, Agent, or Firm*—Edward McC. Roberts; Kevin T. Mansfield

[57] ABSTRACT

The invention relates to a process for the end-to-end dyeing of cellulosic materials, or blends that contain cellulose, with direct and/or reactive dyes by the pad dyeing process, which comprises using an aqueous liquor that contains at least one water-soluble direct or reactive dye and at least one water-soluble anionic, colorless organic compound having an affinity factor A, at a concentration of 0.2 to 0.3 g/l, for mercerized cotton of 1.1 to 4, said factor A being the quotient of the concentration of the water-soluble, colorless organic compound in a liquor without addition of dye, before impregnation, divided by the concentration of the water-soluble, colorless organic compound in the residual liquor without dye after impregnation. The process of this invention is suitable for dyeing textile cellulosic materials or blends containing cellulose to give end-to-end dyeings of good fastness properties.

35 Claims, No Drawings

PROCESS FOR THE END-TO-END DYEING OF CELLULOSIC FIBRES

The present invention relates to a novel process for the end-to-end dyeing of cellulose textile materials with direct or reactive dyes by the pad dyeing process by using an aqueous liquor that, in addition to containing at least one direct or reactive dye, contains at least one anionic water-soluble, colourless, organic compound having good fibre affinity.

The pad dyeing process is a known process for dyeing cellulosic fibres by means of which large yardages of textile materials are dyed by impregnating said materials with the dye solution in a trough, in the shortest liquor ratio and normally with only one passage of the goods on the pad, in a short dyeing time, and subsequently fixing the dyed material.

A known shortcoming of this process is the frequently observed tailing of the dyed materials (batches). By tailing/reserved tailing is meant the differences in strength and shade between the beginning and the end of a batch. If only one dye is used, tailing is apparent in differences in tinctorial strength, whereas in combination shade dyeing, changes in shade may also often occur.

By tailing is meant a decrease in tinctorial strength between the beginning and the end of a batch caused by a decrease in the concentration of dye in the trough. This impoverishment of the dye liquor is caused by dye absorption during the pad process. Differences in tinctorial strength and shade resulting from tailing occur in particular when using dyes of medium to high substantivity and, most frequently, in the dyeing of light shades.

By reversed tailing is meant an increase in tinctorial strength between the beginning and the end of the batch caused by an increase in the dye concentration in the trough. This dye enrichment in the padding liquor is caused by a preferred water adsorption during the pad dyeing process. Differences in tinctorial strength and shade caused by reversed tailing occur if dyes of low substantivity are used, especially when dyeing in dark shades.

The present invention relates to a novel process for the end-to-end dyeing of cellulosic materials, preferably in light shades.

The measures taken so far to improve this deleterious effect, based on investigations into tailing/reversed tailing [Journal of the Society of Dyers and Colourists, 71 (1955), pp. 13–20; of SVF (Schweizerische Vereinigung von Färbereifachleuten)—Fachorgan 16 (1961), pp. 341–351], for example shortening the immersion period, specific choice of dye, and adapting the dye concentration in the padding liquor, which is continuously replenished, to the affinity of the dye for the respective material or dyeing process, have not gained acceptance in actual practice. Thus too short an immersion period is detrimental to heavy, closely woven and insufficiently hydrophilic and slowly swelling fabric. The use of a few selected dyes affords less possibility of adjusting the shade and limits the use of such dyes to the production of only light or dark shades. And varying the dye concentration in the feed liquor is often too complicated for the requirements of actual practice, inter alia because of lack of reproducibility.

There has consequently long been a need to improve the end-to-end dyeing of a batch.

Surprisingly, there has now been found a novel process that does not have the shortcomings referred to and by means of which cellulosic textile materials can be dyed end-to-end in simple manner with direct and/or reactive dyes, especially in light shades, by the pad dyeing process.

Accordingly, the present invention provides a process for the end-to-end dyeing of cellulosic materials, or blends that contain cellulose, with direct and/or reactive dyes by the pad dyeing process, which comprises using an aqueous liquor that contains at least one water-soluble direct or reactive dye and at least one water-soluble anionic, colourless, organic compound having an affinity factor A, at a concentration of 0.2 to 0.3 g/l, for mercerised cotton of 1.1 to 4, said factor A being the quotient of the concentration of the water-soluble, colourless, organic compound in a liquor without addition of dye, before impregnation, divided by the concentration of the water-soluble, colourless, organic compound in the liquor without dye after impregnation.

In the context of this invention, colourless compounds are those whose absorption maximum is outside the range of the visible spectrum or whose absorption in the visible range is very slight.

The water-soluble, colourless, organic compound is a compound having "dye character", i.e. the behaviour of this compound under dyeing conditions conforms to the behaviour of a substantive dye, i.e. the compound has a certain affinity for cellulose.

The colourless, organic compounds preferably contain 1 to 6, most preferably 1 to 4, acid water-solubilising groups which are preferably carboxyl groups or, in particular, sulfonic acid groups. The water-soluble, colourless, organic compounds preferably contain no further ionic groups and no halogen-containing heterocycles of aromatic character, e.g. halotriazines.

Surprisingly, the process of this invention is equally suitable for dyeing all pure cellulosic fibres, e.g. mercerised and caustified or bleached cotton or viscose rayon, as well as for dying blends containing cellulose, e.g. polyester/cellulose blends, without being limited to specific direct or reactive dyes or specific fibre-reactive groups of reactive dyes. It is also surprising that level end-to-end dyeings are obtained, irrespective of the concentration of the dyes, irrespective of the electrolyte or alkali content, irrespective of conventional dyeing auxiliaries (e.g. wetting agents), irrespective of the immersion time and the contents of the trough.

The direct dyes suitable for use in the process of this invention are the conventional direct dyes, for example those listed in the Colour Index, 3rd Edition (1971), Vol. 2, on pages 2005–2478.

By reactive dyes are meant the customary dyes that form a covalent bond with cellulose, e.g. the reactive dyes listed in the colour Index, 3rd Edition (1971), Vol. 3, on pages 3391–3560, and in Vol. 6 (revised 3rd edition, 1975) on pages 6268–6345.

In the process of this invention it is preferred to use direct or reactive dyes having an affinity factor B for mercerised cotton, at a concentration of 0.1 g/l, of at least 1.1. The affinity factor B is the quotient of the concentration of the dye in the original liquor without addition of the water-soluble, colourless, organic compound divided by the concentration of the dye in the liquor after impregnation.

If dye mixtures are used in the process of this invention, e.g. mixtures of different reactive dyes or of different direct dyes, or mixtures of different direct and reactive dyes, then at least one of the dyes employed should have an affinity factor B of at least 1.1.

The affinity factor A of the water-soluble, colourless, organic compound and the affinity factor B of the direct or reactive dyes are determined by measuring the concentration of the original liquor and of the liquor after impregnation by forming the ratio of the measured concentrations, i.e.

$$A \text{ and } B = \frac{\text{concentration of the liquor before impregnation}}{\text{concentration of the liquor after impregnation}}$$

The concentration of the original liquor corresponds to the amounts of dye or colourless organic compound. The concentration of the liquors before and after impregnation is measured by methods which are known per se, e.g. spectrophotometrically, e.g. at the absorption maximum, or by chromatography (e.g. HPLC).

Mercerised cotton is used for determining the affinity factor A of 1.1 to 4 as well as for determining the affinity factor B of at least 1.1, with the concentration of water-soluble, colourless organic compound being 0.2 to 0.3 g/l, and that of direct or reactive dye being 0.1 g/l, in the liquor before impregnation.

To determine the affinity factor A and B, the water-soluble, colourless organic compound is used alone or the direct or reactive dye is used alone.

The procedure for determining the affinity factors A and B is that the mercerised cotton [140 g/m$^2$, thread count/cm$^2$: warp /weft 25/22, yarn count: tex warp-/weft 30/30] is conditioned at 25° C. and 60% relative humidity to constant weight, the fabric is impregnated at room temperature to a pick-up of c. 200 percent by weight with the original liquor contains a salt, preferably $Na_2SO_4$, e.g. 10 g/l of $Na_2SO_4$, then expressed to a pick-up of 70% by weight after an immersion period of c. 2–4 seconds (including airing), and the concentration of dye or colourless compound in the liquor after impregnation is determined.

The amount of dye in the process of this invention will normally depend on the desired tinctorial strength, with tailing being evident especially when dyeing in light shades, i.e. at a concentration of 0.05 g/l or less to about 20 g/l.

Preferred embodiments of the process of this invention comprise:

(a) using an aqueous liquor wherein the maximum concentration of direct or reactive dye, together with the water-soluble, colourless, organic compound, is 20 g/l, preferably 10 g/l and, most preferably, 3 g/l to 8 g/l;

(b) using an aqueous liquor wherein the total concentration of direct or reactive dye is less than 5 g/l, preferably less than 3 g/l;

(c) using a water-soluble anionic, colourless organic compound having an affinity factor A of 1.15 to 2.5, preferably 1.2 to 1.6, in accordance with the above described test conditions.

A particularly preferred embodiment of the process of this invention comprises using a mixture of (1) at least one direct or reactive dye or at least one direct dye and at least one reactive dye, and (2) at least one water-soluble, anionic, colourless organic compound, such that said mixture has a dye affinity factor B of 0.9 to 1.15, preferably 0.95 to 1.1.

The abbreviation "g/l" denotes grams per liter.

The amount of water-soluble, colourless organic compound in the process of the invention depends in particular on the amount of dye employed and on the factor B. A minimum amount of 0.5 g/l has proved useful.

Preferred colourless compounds eligible for use in the process of this invention are (a) azines of formula

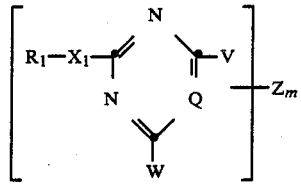

(1)

wherein

Q is =CH—$R_x$ or, preferably, =N—, $R_x$ is hydrogen, halogen, cyano, $C_1$-$C_4$alkyl or $C_1$-$C_4$alkylsulfonyl, V and W are each independently of the other $R_2$—$X_2$—, $R_3$—$X_3$—, hydroxy, $C_1$-$C_4$alkoxy, an unsubstituted amino group or an amino group which is substituted by one or two $C_1$-$C_4$alkyl radicals which are in turn unsubstituted or substituted by hydroxy, cyano, sulfo (—$SO_3H$) or sulfato (—O-$SO_3H$), $R_1$, $R_2$ and $R_3$ are each independently an aromatic or heteroaromatic radical, $X_1$, $X_2$ and $X_3$ are each independently —O—, —S—,

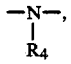

or —NH—CO—Phen—NH—, $R_4$ is hydrogen, $C_1$-$C_4$alkyl or phenyl,

Phen is an unsubstituted or substituted phenyl group,

Z is an acid water-solubilising group, and m is an integer from 1 to 6; or (b) compounds of formula $$[R_1\text{—NH—A—}R_2\text{—}Z_m \qquad (2)$$

wherein $R_1$, $R_2$, Z and m have the given meanings

A is a direct bond, —CO—, —CONH— or

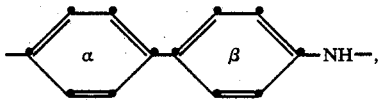

and the rings α and β are unsubstituted or substituted; or (c) compounds of formula

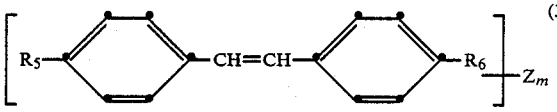

(3)

wherein $R_5$ and $R_6$ are each independently of the other —$NH_2$, —NH—CO—$R_7$, —$NO_2$ or (3a)

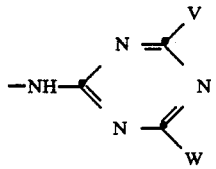

$R_7$ is $C_1$–$C_8$alkyl, e.g. methyl or ethyl, or aryl such as phenyl, and

V, W, Z and m have the given meanings; or (d) compounds of formula (4)

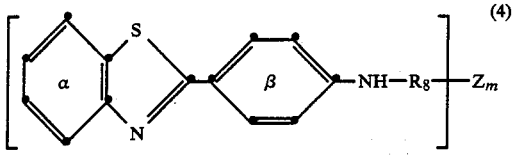

wherein $R_8$ is hydrogen or $R_9$—CO—, and $R_9$ is an aliphatic, aromatic or heterocyclic radical, preferably $C_1$–$C_4$alkyl or phenyl, the rings α and β are unsubstituted or substituted and Z and m have the given meanings.

$C_1$–$C_4$Alkyl denotes alkyl radicals or alkyl moieties that contain 1 to 4 carbon atoms and can be in straight chain or branched configuration. Examples of such radicals are: methyl, ethyl, n-propyl, isopropyl, n-butyl, sec-butyl, isobutyl and tert-butyl.

Halogen is for example fluorine, bromine or, preferably chlorine.

Acyl is preferably formyl, $C_1$–$C_4$alkylcarbonyl, e.g. acetyl or propionyl, or benzoyl.

Water-solubilising groups Z are preferably carboxyl groups or, most preferably, sulfonic acid groups. A compound can contain only carboxyl groups or only sulfo groups as well as both carboxyl and sulfo groups.

m is preferably 1 to 4. Compounds of formulae (1) to (3) thus contain preferably 2 to 4 water-solubilising groups Z, whereas the other compounds of formula (4) preferably contain 1 or 2 water-solubilising groups Z.

Suitable substituents of the Phen groups and of the rings α and β are: hydroxy, cyano, nitro, halogen such as fluorine, chlorine, or bromine; $C_1$–$C_4$alkyl, e.g. methyl, ethyl, propyl, isopropyl, or butyl; trifluoromethyl; $C_1$–$C_4$alkoxy, e.g. methoxy, ethoxy, propoxy, isopropoxy or butoxy; $C_1$–$C_5$alkoxycarbonyl, amino, mono- or di($C_1$–$C_4$)alkylamino, phenylamino, carbamoyl, sulfamoyl, ureido; $C_1$–$C_7$acylamino, e.g. acetylamino, propionylamino or benzoylamino; $C_1$–$C_4$alkylsulfonyl, e.g. methylsulfonyl, sulfomethyl, or sulfatoethyl.

In the compounds of formula (1), V is preferably $R_2$—$X_2$— and W is preferably $R_3$—$X_3$—. Particularly preferred compounds of formula (1) are those wherein $X_1$, $X_2$ and $X_3$ are —NH—, or V and W are each independently of the other preferably —OH or —$NH_2$. Most preferred are compounds of formula (1), wherein $R_1$, $R_2$ and $R_3$ are an aryl radical, e.g. a naphthyl radical or, preferably, a phenyl radical.

Compounds of formula (3), wherein $R_5$ and $R_6$ are each a triazinylamino radical of formula (3a), are also of considerable interest.

Representative examples of the large number of possible water-soluble, colourless organic compounds are compounds of the following formulae:

(5)

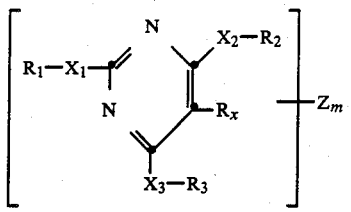

(6)

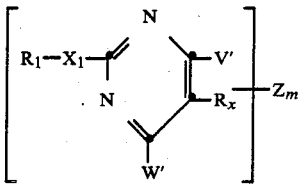

(7)

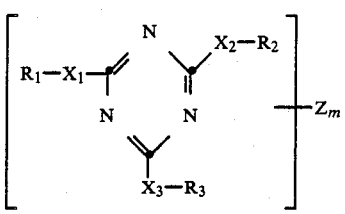

(8)

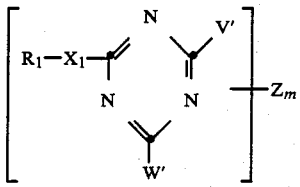

$[R_1—NH—R_2]—Z_m$ (9)

$[R_1—NH—CO—R_2]—Z_m$ (10)

$[R_1—NH—CO—NH—R_2]—Z_m$ (11)

(12)

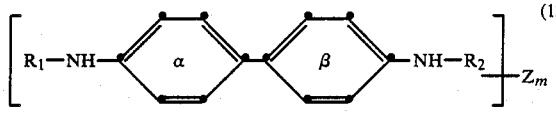

wherein $R_x$ has the given meaning,

V' and W' are each independently of the other hydroxy, $C_1$–$C_4$alkoxy, or an unsubstituted amino group or an amino group which is substituted by one or two $C_1$–$C_4$alkyl radicals which are in turn unsubstituted or substituted by hydroxy, cyano, sulfo, or sulfato, and V' is also the radical $R_2$—$X_2$—, $R_1$, $R_2$ and $R_3$ are each independently an aromatic or heteroaromatic radical, e.g. a phenyl, biphenylyl, naphthyl, stilbenyl or quinolinyl radical, and, except for Z, may contain any further nonionic substituents such as $C_1$–$C_4$alkyl groups, e.g. methyl, ethyl, propyl, isopropyl or butyl, $C_1$–$C_4$alkoxy groups such as methoxy, ethoxy, propoxy, isopropoxy or butoxy, $C_1$–$C_7$acylamino groups such as acetylamino, propionylamino or benzoylamino, amino, mono- or di($C_1$–$C_4$)alkylamino, phenylamino, $C_1$–$C_4$alkoxy carbonyl, nitro, cyano, trifluoromethyl, halogen such as fluorine, chlorine or bromine, sulfamoyl, carbamoyl, ureido, hydroxy, $C_1$–$C_4$alkylsulfonyl, e.g. methylsulfonyl, or sulfomethyl ($HO_3S$—$CH_2$), $X_1$, $X_2$ and $X_3$ are each independently —O—, —S—, —N($R_4$)— or

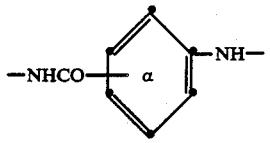

and $R_4$ is hydrogen, $C_1$–$C_4$alkyl or phenyl and the benzene rings α and β may be substituted by one or more nonionic substituents as indicated for $R_1$, and Z is a water-solubilising group, e.g. a carboxyl group or, preferably, a sulfonic acid group, and m is 2, 3, 4, 5 or 6, preferably 2 to 4.

Of primary interest are triazines of formula (7), wherein $X_1$, $X_2$ and $X_3$ are each —NH—, $R_1$, $R_2$ and $R_3$ are each independently phenyl or naphthyl, Z is a sulfo group and m is 2 or preferably 3.

Particularly interesting compounds are e.g. those of formulae

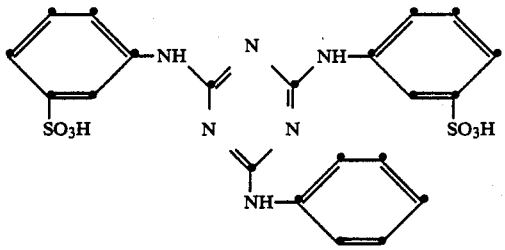

(13)

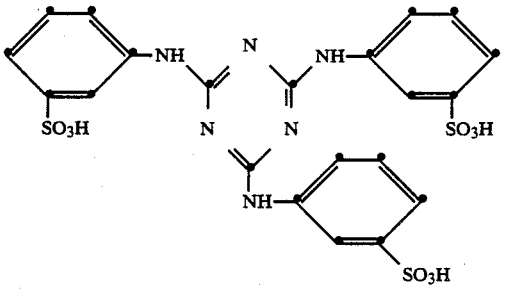

(14)

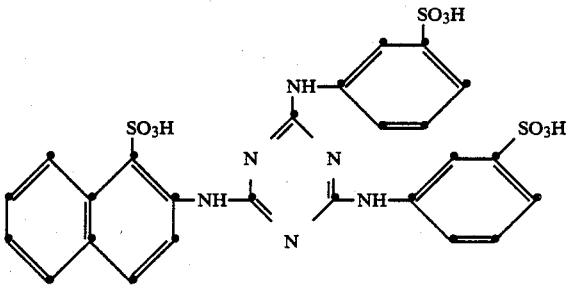

(15)

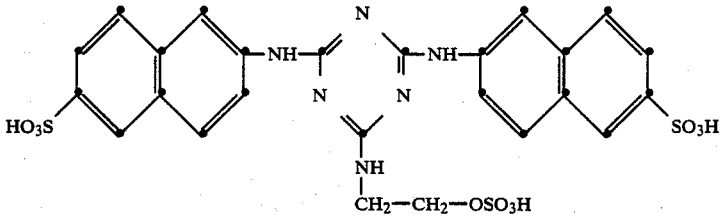

(16)

-continued
(17)
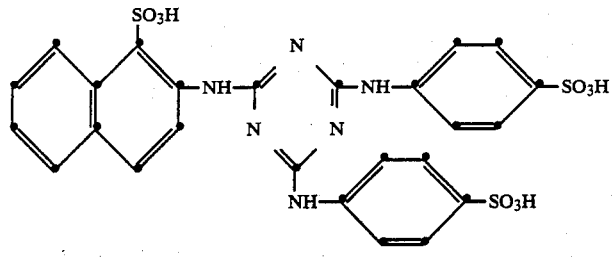
(18)
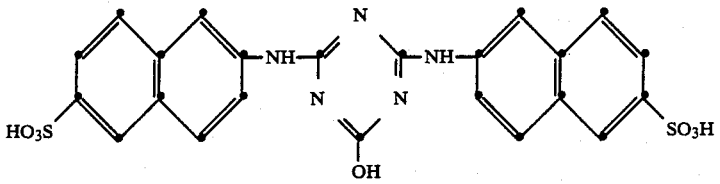
(19)
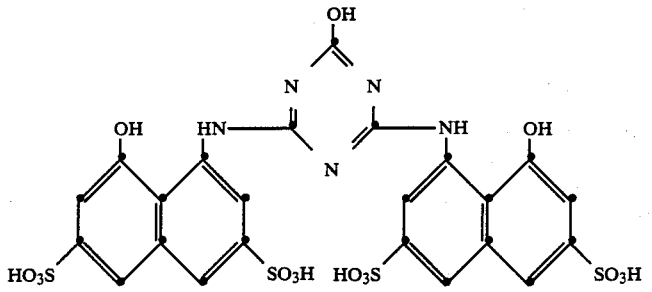
(20)
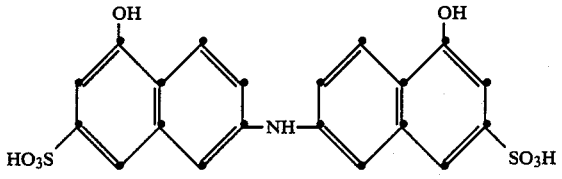
(21)
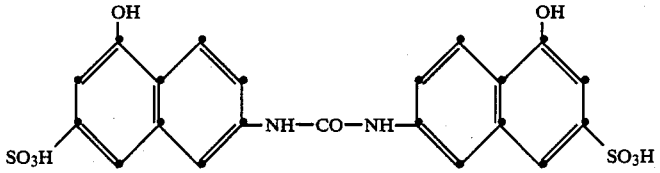
(22)
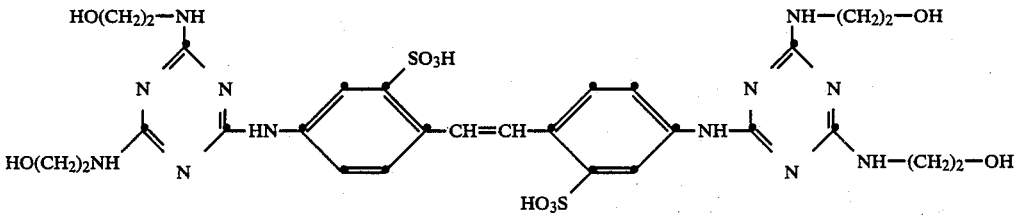
(23)
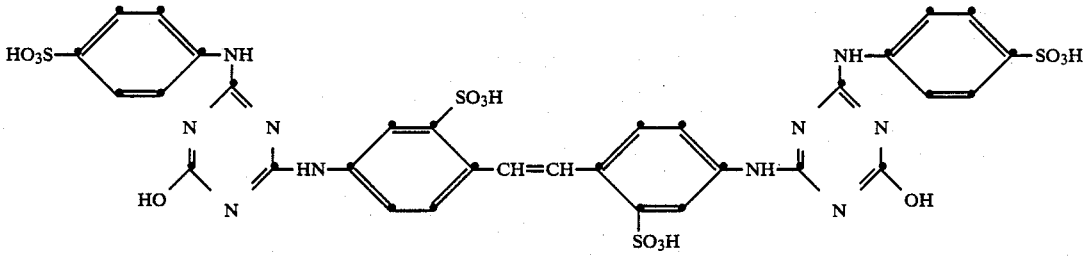

-continued

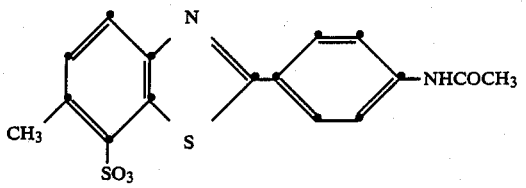

(24)

The compounds employed in the process of this invention are either in the form of the free acid or, preferably, of their salts. Examples of suitable salts are the alkali metal, alkaline earth metal or ammonium salts or the salts of an organic amine. Representative examples are the sodium, potassium or ammonium salts or the salt of triethanolamine.

The water-soluble, colourless organic compounds employed in the process of this invention are known per se and can be prepared by methods which are known per se.

As preferred embodiment of the process of the invention comprises using at least one water-soluble reactive dye of formula $$D-(X)_q \quad (25)$$

wherein D is the radical of an organic dye, e.g. of the monoazo, polyazo, metal complex azo, anthraquinone, phthalocyanine, formazan, azomethine, nitroaryl, dioxazine, phenazine or stilbene series, X is a fibre-reactive radical of the aliphatic, aromatic or heterocyclic series which is attached to the radical D direct or through a bridge, and q is 1, 2, 3, 4, 5 or 6.

In the process of this invention, the reactive dyes of formula (25) can contain up to six identical or different fibre-reactive radicals.

By fibre-reactive radicals X are meant those radicals that are able to react with the hydroxyl groups of cellulose, the amino, carboxyl, hydroxyl and thiol groups of wool and silk, or with the amino and, where available, carboxyl groups of synthetic polyamides to form covalent bonds.

Preferably X is a fibre-reactive radical of the aliphatic, aromatic or heterocyclic series, which radical is attached to the radical D direct or through a bridge.

The fibre-reactive radical X is preferably attached to the radical D direct or through an unsubstituted or monoalkylated amino group such as —NH—, —N($CH_3$)—, —N($C_2H_5$)— or —N($C_3H_7$)— or through a bridge that carries an amino group, e.g. phenylene.

Suitable fibre-reactive radicals X in formula (25) are for example the following aliphatic or aromatic radicals: vinylsulfonyl, β-chloroethylsulfonyl, β-sulfatoethylsulfonyl, β-acetoxyethylsulfonyl, phosphonooxyethylsulfonyl, β-thiosulfatoethylsulfonyl, N-methyl-N-(β-sulfatoethylsulfonyl)amino, acryloyl, monochloroacryloyl, dichloroacryloyl or trichloroacryloyl such as —CO—CCl=$CH_2$, —CO—CH=CH—Cl, —CO—CCl=CH—$CH_3$; monobromoacryloyl, dibromoacryloyl or tribromoacryloyl such as —CO—CBr=$CH_2$, —CO—CH=CH—Br, —CO—CBr=CH—$CH_3$; as well as —CO—CCl=CH—COOH, —CO—CH=CCl—COOH, —CO—CBr=CH—COOH, —CO—CH=CBr—COOH; —CO—CCl=CCl—COOH, —CO—CBr=CBr—COOH; precursors of the acryloyl radical and of derivatives of the acryloyl radical such as β-chloropropionyl, β-bromopropionyl, 3-phenylsulfonylpropionyl, 3-methylsulfonylpropionyl, 3-chloro-3-phenylsulfonylpropionyl, 2,3-dichloropropionyl, 2,3-dibromopropionyl; as well as 2-fluoro-2-chloro-3,3-difluorocyclobutane-1-carbonyl, 2,2,3,3-tetrafluorocyclobutane-1-carbonyl or -1-sulfonyl, β-(2,2,3,3-tetrafluorocyclobut-1-yl)acryloyl, α- or β-alkenylsulfonylacryloyl or -arylsulfonylacryloyl groups, such as α- or β-methylsulfonylacryloyl, propiolyl, chloroacetyl, bromoacetyl, 4-(β-chloroethylsulfonyl)butyryl, 4-vinylsulfonylbutyryl, 5-(β-chloroethylsulfonyl)valeryl, 5-vinylsulfonylvaleryl, 6-(β-chloroethylsulfonyl)caproyl, 6-vinylsulfonylcaproyl; as well as 4-fluoro-3-nitrobenzoyl, 4-fluoro-3-nitrophenylsulfonyl, 4-fluoro-3-methylsulfonylbenzoyl, 4-fluoro-3-cyanobenzoyl, and 2-fluoro-5-methylsulfonylbenzoyl.

Further examples of fibre-reactive radicals X belong to the heterocyclic series, such as 2,4-dichlorotriazin-6-yl, monohalopyrimidinyl, dihalopyrimidinyl or trihalopyrimidinyl radicals, such as 2,4-dichloropyrimidin-6-yl, 2,4,5-trichloropyrimidin-6-yl, 2,4-dichloro-5-nitro or 5-methyl or 5-carboxymethyl- or -5-carboxy-or -5-cyano or -5-vinyl- or -5-sulfo- or -5-monochloromethyl, -dichloromethyl- or trichloromethyl- or 5-methylsulfonyl-6-pyrimidinyl, 2,5-dichloro-4-methylsulfonyl-6-pyrimidinyl, 2-fluoro-4-pyrimidinyl, 2,6-difluoro-4-pyrimidinyl, 2,6-difluoro-5-chloro-4-pyrimidinyl, 2-fluoro-5,6-dichloro-4-pyrimidinyl, 2,6-difluoro-5-methyl-4-pyrimidinyl, 2,5-difluoro-6-methyl-4-pyrimidinyl, 2-fluoro-5-methyl-6-chloro-4-pyrimidinyl, 2-fluoro-5-nitro-6-chloro-4-pyrmidinyl, 5-bromo-2-fluoro-4-pyrimidinyl, 2-fluoro-5-cyano-4-pyrimidinyl, 2-fluoro-5-methyl-4-pyrimidinyl, 2,5,6-trifluoro-4-pyrimidinyl, 5-chloro-6-chloromethyl-2-fluoro-4-pyrimidinyl, 2,6-difluoro-5-bromo-4-pyrimidinyl, 2-fluoro-5-bromo-6-chloromethyl-4-pyrimidinyl, 2,6-difluoro-5-chloromethyl-4-pyrimidinyl, 2,6-difluoro-5-nitro-4-pyrimidinyl, 2-fluoro-6-methyl-4-pyrimidinyl, 2-fluoro-5-chloro-6-methyl-4-pyrimidinyl, 2-fluoro-5-chloro-4-pyrimidinyl, 2-fluoro-6-chloro-4-pyrimidinyl, 6-trifluoromethyl-5-chloro-2-fluoro-4-pyrimidinyl, 6-trifluoromethyl-2-fluoro-4-pyrimidinyl, 6-trifluoromethyl-2-fluoro-4-pyrimidinyl, 2-fluoro-5-nitro-4-pyrimidinyl, 2-fluoro-5-trifluoromethyl-4-pyrimidinyl, 2-fluoro-5-phenyl or 5-methylsulfonyl-4-pyrimidinyl, 2-fluoro-5-carbamoyl-4-pyrimidinyl, 2-fluoro-5-carbomethoxy-4-pyrimidinyl, 2-fluoro-5-bromo-6-trifluoromethyl-4-pyrimidinyl, 2-fluoro-6-carbamoyl-4-pyrimidinyl, 2-fluoro-6-carbomethoxy-4-pyrimidinyl, 2-fluoro-6-phenyl-4-pyrimidinyl, 2-fluoro-6-cyano-4-pyrimidinyl, 2,6-difluoro-5-methylsulfonyl-4-pyrimidinyl, 2-fluoro-5-sulfonamido-4-pyrimidinyl, 2-fluoro-5-chloro-6-carbomethoxy-4-pyrimidinyl, 2,6-difluoro-5-trifluoromethyl-4-pyrimidinyl; 2,4-bismethylsulfonylpyrimidin-4-yl, 2,5-bismethylsulfonyl-5-chloropyrimidin-4-yl, 2-methylsulfonylpyrimidin-4-yl, 2-phenylsulfonylpyrimidin-4-yl, 2-methylsulfonyl-5-chloro-6-methylpyrimidin-4-yl, 2-methylsulfonyl-5-bromo-6-methylpyrimidin-4-yl, 2-methylsulfonyl-5-chloro-6-ethylpyrimidin-4-yl, 2-methylsulfonyl-5-chloromethylpyrimidin-4-yl, 2-methylsulfonyl-5-nitro-6-methylpyrimidin-4-yl, 2,5,6-trismethylsulfonylpyrimidin-4-yl, 2-methylsulfonyl-5,6-dimethylpyrimidin-4-yl, 2-ethylsulfonyl-5-chloro-6-methylpyrimidin-4-yl, 2-methylsulfonyl-6-chloropyrimidin-4-yl, 2,6-bismethylsulfonyl-5-chloropyrimidin-4-yl, 2-methylsulfonyl-6-carboxypyrimidin-4-yl, 2-methylsulfonyl-5-sulfopyrimidin-4-yl, 2-methylsulfonyl-6-carbomethoxypyrimidin-4-yl, 2-methylsulfonyl-5-carboxypyrimidin-4-yl, 2-methylsulfonyl-5-cyano-6-methoxypyrimidin-4-yl, 2-methylsulfonyl-5-chloropyrimidin-4-yl, 2-sulfoethylsulfonyl-6-methylpyrimidin-4-yl, 2-methylsulfonyl-5-bromopyrimidin-4-yl, 2-phenylsulfonyl-5-chloropyrimidin-4-yl, 2-carboxymethylsulfonyl-5-chloro-6-methylpyrimidin-4-yl, 2,4-dichloropyrimidine-6-carbonyl or -6-sulfonyl, 2,4-dichloropyrimidine-5-carbonyl or -5-sulfonyl, 2-chloro-4-methylpyrimidine-5-carbonyl, 2-methyl-4-chloropyrimidine-5-carbonyl, 2-methylthio-4-fluoropyrimidine-5-carbonyl, 6-methyl-2,4-dichloropyrimidine-5-carbonyl, 2,4,6-trichloropyrimidine-5-carbonyl, 2,4-dichloropyrimidine-5-sulfonyl, 2,4-dichloro-6-methylpyrimidine-5-carbonyl or -5-sulfonyl, 2-methylsulfonyl-6-chloropyrimidine-4-and -5-carbonyl, 2,6-bis-(methylsulfonyl)pyrimidine-4- or -5-carbonyl, 2-ethylsulfonyl-6-chloropyrimidine-5-carbonyl, 2,4-bis(methylsulfonyl)pyrimidine-5-sulfonyl, 2-methylsulfonyl-4-chloro-6-methyl-pyrimidine-5-sulfonyl or -5-carbonyl, 2-chloroquinoxaline-3-carbonyl, 2- or 3-monochloroquinoxaline-6-carbonyl, 2- or 3-monochloroquinoxaline-6-sulfonyl, 2,3-dichloroquinoxaline-5- or -6-carbonyl, 2,3-dichloroquinoxaline-5- or -6-sulfonyl, 1,4-dichlorophthalazine-6-sulfonyl- or -6-carbonyl, 2,4-dichloroquinazoline-7-or -6-sulfonyl or -carbonyl, 2,4,6-trichloroquinazoline-7- or -8-sulfonyl, 2- or 3- or 4-(4',5'-dichloropyridazinone-6'-yl-1')-propionyl, 3,6-dichloropyridazine-4-carbonyl or -4-sulfonyl, 2-chlorobenzothiazole-5- or -6-carbonyl or -5- or -6-sulfonyl, 2-arylsulfonyl- or -alkylsulfonylbenzothiazole-5- or -6-carbonyl- or -5- or -6-sulfonyl, such as 2-methylsulfonylbenzothiazole- or 2-ethylsulfonylbenzothiazole-5- or -6-sulfonyl or -carbonyl, 2-phenylsulfonylbenzothiazole-5- or -6-sulfonyl- or -carbonyl and the corresponding 2-sulfonylbenzothiazole-5- or -6-carbonyl or -sulfonyl derivatives which contain sulfo groups in the fused benzene ring, 2-chlorobenzoxazole-5- or -6-carbonyl or -sulfonyl, 2-chlorobenzimidazole-5-or -6-carbonyl- or -sulfonyl, 2-chloro-1-methylbenzimidazole-5- or -6-carbonyl- or -sulfonyl, 2-chloro-4-methylthiazole-(1,3)-5-carbonyl or -4- or -5-sulfonyl; ammonium-containing triazine rings, such as 2-trimethylammonium-4-phenyl amino- or 4-(o-, m- or p-sulfophenyl)amino-6-triazinyl, 2-(1,1-dimethylhydrazinium)-4-phenylaminotriazin-6-yl, 2-(1,1-dimethylhydrazinium)-4-(o-, m- or p-sulfophenyl)aminotriazin-6-yl, 2-(2-isopropylidene-1,1-dimethyl)hydrazinium-4-phenylaminotriazin-6-yl, 2-(2-isopropylidene-1,1-dimethyl)hydrazinium-4-(o-, m- or p-sulfophenyl)aminotriazin-6-yl, 2-N-aminopyrrolidinium- or 2-N-aminopiperidinium-4-phenylaminotriazin-6-yl or -4-(o-, m- or p-sulfophenyl)aminotriazin-6-yl, and also 4-phenylaminotriazin-6-yl and 4-(sulfophenylamino)triazin-6-yl radicals which contain 1,4-bisazabicyclo[2.2.2]octane or 1,2-bisazabicyclo[0.3.-3]octane attached through a quaternary nitrogen bound in the 2-position, 2-pyridinium-4-phenylaminotriazin-6-yl or 2-pyridinium-4-(o-, m- or p-sulfophenyl)aminotriazin-6-yl as well as the corresponding 2-oniumtriazin-6-yl radicals which are substituted in the 4-position by alkylamino such as methylamino, ethylamino or β-hydroxyethylamino, alkoxy such as methoxy or ethoxy, or aryloxy such as phenoxy, or sulfophenoxy groups.

Particularly interesting fibre-reactive radicals are fluoro- or chloro-1,3,5-triazine radicals of the formula

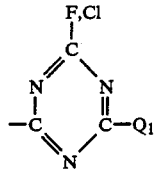

wherein the substituent $Q_1$ on the triazine ring may be in particular: —$NH_2$, alkylamino, N,N-dialkylamino, cycloalkylamino, N,N-dicycloalkylamino, aralkylamino and arylamino groups, mixed substituted amino groups such as N-alkyl-N-cyclohexylamino and N-alkyl-N-arylamino groups, amino groups which contain heterocyclic radicals which may carry further fused carbocyclic rings, amino groups in which the amino nitrogen atom is part of a N-heterocyclic ring which may contain further heteroatoms, and hydrazino and semicarbazido. The above-mentioned alkyl radicals can be straight-chain or branched and be of low molecular weight or higher molecular weight, with alkyl radicals of 1 to 6 carbon atoms being preferred; suitable cycloalkyl, aralkyl and aryl radicals are in particular cyclohexyl, benzyl, phenethyl, phenyl and naphthyl radicals: heterocyclic radicals are in particular furan, thiophene, pyrazole, pyridine, pyrimidine, quinoline, benzimidazole, benzothiazole and benzoxazole radicals; and amino groups in which the amino nitrogen atom is part of a N-heterocyclic ring are preferably radicals of 6-membered N-heterocyclic compounds which may contain nitrogen, oxygen or sulfur as further heteroatoms. The above-mentioned alkyl, cycloalkyl, aralkyl and aryl radicals, the heterocyclic radicals and the N-heterocyclic rings may be further substituted, for example by: halogen such as fluorine, chlorine and bromine; nitro, cyano, trifluoromethyl, sulfamoyl, carbamoyl, $C_{1-4}$alkyl, $C_{1-4}$alkoxy; acylamino groups such as acetylamino or benzoylamino; ureido, hydroxyl, carboxyl, sulfomethyl or sulfo. Examples of amino groups of this type are: —$NH_2$, methylamino, ethylamino, propylamino, isopropylamino, butylamino, hexylamino, β-methoxyethylamino, γ-methoxypropylamino, β-ethoxyethylamino, N,N-dimethylamino, N,N-diethylamino, β-chloroethylamino, β-cyanoethylamino, γ-cyanopropylamino, β-carboxyethylamino, sulfomethylamino, β-sulfoethylamino, β-hydroxyethylamino, N,N-di-β-hydroxyethylamino, γ-hydroxypropylamino, benzylamino, phenethylamino, cyclohexylamino, phenylamino, toluidino, xylidino, chloroanilino, anisidino, phenetidino, N-methyl-N-phenylamino, N-ethyl-N-phenylamino, N-β-hydroxyethyl-N-phenylamino, 2-, 3- or 4-sulfoanilino, 2,5-disulfoanilino, 4-sulfomethylanilino, N-sulfomethylanilino, 2-, 3- or 4-carboxyphenylamino, 2-carboxy-5-sulfophenylamino, 2-carboxy-4-sulfophenylamino, 4-sulfonaphth-1-ylamino, 3,6-disulfonaphth-1-ylamino, 3,6,8-trisulfonaphth-1-ylamino, 4,6,8-trisulfonaphth-1-ylamino, 1-sulfonaphth-2-ylamino, 1,5-disulfonaphth-2-ylamino, 6-sulfonaphth-2-ylamino, morpholino, piperidino, piperazino, hydrazino and semicarbazido.

In the process of this invention it is preferred to use water-soluble reactive dyes of formula $$\left[D-(X)_q\right]-(SO_3^{\ominus}Ka)_N \qquad (26)$$

wherein D is the radical of a monoazo, disazo, metal complex azo, anthraquinone, formazan or dioxazine dye, Ka is a cation and n is 1, 2, 3, 4, 5 or 6, and X and q are as defined for formula (25). Preferably q is 1 or 2 and, independently thereof, n is 2, 3 or 4.

The cation Ka in formula (26) is e.g. a hydrogen, sodium, potassium, lithium or ammonium ion, or the cation of an organic amine, e.g. of triethanolamine.

Suitable water-soluble reactive dyes of formula (26) are the dyes referred to in connection with the definition of the radical D for formula (25), which dyes contain from one to six, preferably up to two, fibre-reactive radicals X.

The reactive dyes of formula (25) or (26) can contain up to six identical or different fibre-reactive groups.

The reactive dyes of formula (25) or (26) preferably contain highly reactive radicals X. These will be understood as meaning radicals X which are more reactive than 2-chloro-1,3,5-triazinyl radicals which are substituted in the 4-position by one of the abovementioned substituents $Q_1$. Examples of such highly reactive radicals X are: 2-fluoro-4-$Q_1$-triazin-6-yl, wherein $Q_1$ is one of the substituents cited above, 2,4-dichlorotriazin-6-yl, 2,4-dichloropyrimidine-5-carbonyl, 5-cyano- or 5-methylsulfonyl-2,4-dichloropyrimidin-6-yl, difluorochloropyrimidinyl, e.g. 2,4-difluoro-5-chloropyrimidin-6-yl, 2,3-dichloroquinoxaline-6-carbonyl, vinylsulfonyl, β-sulfatoethylsulfonyl, β-chloroethylsulfonyl, β-thiosulfatoethylsulfonyl and β-acetoxyethylsulfonyl.

In the process of this invention it is particularly preferred to use reactive dyes of formula (26), wherein X is a radical of formula

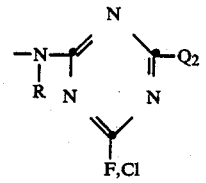

(27)

wherein R is hydrogen or $C_1$–$C_4$alkyl, e.g. methyl, ethyl, propyl, isopropyl, butyl, sec-butyl, isobutyl or tert-butyl, and $Q_2$ is a substituted or unsubstituted amino group, a difluorochloropyrimidinyl radical which is attached to the benzene ring through a phenylenediamine radical, or is a vinylsulfonyl, β-sulfatoethylsulfonyl, β-thiosulfatoethylsulfonyl, β-chloroethylsulfonyl or β-acetoxyethylsulfonyl radical which is attached to the benzene ring direct or through an aromatic or aliphatic bridge.

The reactive dyes of the formula (25) or (26) are derived in particular from the following dyes:

1. Monoazo compounds of formula

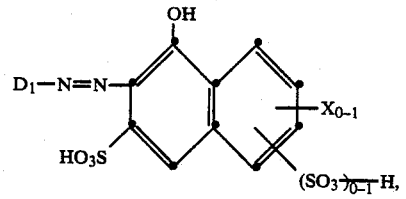

(28)

wherein $D_1$ is a radical of the benzene or naphthalene series, for example the phenyl, naphthyl, stilbene, diphenyl, benzthiazolylphenyl or diphenylamine radical which may be substituted by sulfo groups, halogen such as chlorine, acylamino groups such as acetylamino or benzoylamino, amino groups such as —$NH_2$ and methylamino, alkoxy such as methoxy, hydroxy or carboxy, as well as fibre-reactive radicals X. X is preferably attached to the 5-, 6-, 7- or 8-position of the naphthalene nucleus direct or through an imino group such as —NH— or $$-\underset{|}{N}CH_3,$$

and is as defined for formula (25).

2. Disazo compounds of the formula (28), wherein $D_1$ is a radical of the azobenzene, azonaphthalene or phenylazonaphthalene series, and $D_1$ and the naphthalene nucleus may be substituted, as indicated for class 1.

3. Disazo compounds of formula

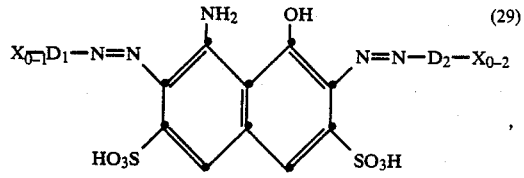

(29)

wherein at least one X is present and X is as defined for formula (25), and $D_2$ and $D_3$ each independently are as defined for $D_1$ in formula (28).

4. Monoazo compounds of formula

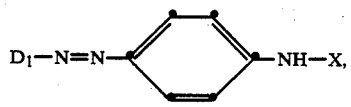

(30)

wherein $D_1$ is a radical as defined for formula (28), in particular a disulfonaphthyl or stilbene radical, and X is as defined for formula (25) and the benzene nucleus may contain further substituents, for example halogen atoms or alkyl, alkoxy, carboxylic acid, ureido or acylamino groups.

5. Mono- or disazo compounds of formula $$X-D_4-N=N-K_1 \qquad (31),$$

wherein $D_4$ is a radical of the azobenzene, azonaphthalene or phenylazonaphthalene series or is preferably a radical of the benzene or naphthalene series which may be substituted by the substituents as indicated for $D_1$ in formula (28), and $K_1$ is the radical of a naphtholsulfonic acid or the radical of a ketomethylene compound, for example an acetoacetarylide, preferably an acetoacetanilide, or a 5-pyrazolone, preferably a 1-phenyl-3-methyl-5-pyrazolone, in which the OH group is in the ortho-position to the azo group, and X is attached to $D_4$ direct or through an amino group, e.g. —$NH_2$, methylamino or benzoylamino. Preferably $D_4$ is a radical of the benzene series which contains a sulfonic acid group. X is as defined for formula (25).

6. Mono- or disazo compounds of the formula $$D_1-N=N-K_2-X \qquad (32),$$

wherein $D_1$ is a radical as defined for $D_1$ in classes 1 and 2 above and $K_2$ is the radical of an enolisable ketomethylene compound such as an acetoacetarylide, preferably an acetoacetanilide or a 5-pyrazol-one, preferably a 1-phenyl-3-methyl-5-pyrazolone, in which the OH group is in the ortho-position to the azo group and X is as defined for classes 1 to 5.

7. Metal complex compounds, e.g. copper, chromium and cobalt complexes of the dyes of formulae (28) to (32), wherein $D_1$ to $D_4$, $K_1$ and $K_2$ have the given meanings and further contain a metallisable group, for example a hydroxyl, methoxy or carboxylic acid group, in the ortho-position to the azo group.

8. Anthraquinone compounds in which the radical X is attached to an alkylamino or arylamino group which is itself attached to the α-position of the anthraquinone nucleus, in particular anthraquinone compounds of formula

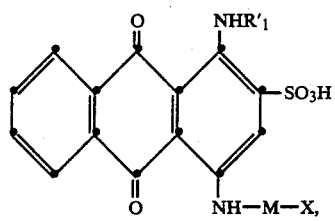

(33)

wherein $R_1'$ is hydrogen, alkyl or aryl, preferably phenyl, and M is a bridge which is preferably a divalent radical of the benzene series, for example a phenylene, diphenylene or 4,4'-stilbene or azobenzene radical. The bridge M should preferably contain a sulfo group for every benzene ring present. The anthraquinone nucleus can additionally contain a sulfo group in the 5-, 6-, 7- or 8-position. The radical X is attached to M direct or through an amino group.

9. Phthalocyanine compounds of formula

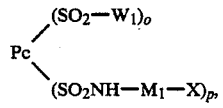

(34)

wherein Pc is a phthalocyanine nucleus, preferably copper phthalocyanine, $W_1$ is OH and/or $—NH_2$, $M_1$ is a bridge, preferably an aliphatic, cycloaliphatic or aromatic bridge, and o and p are each 1, 2 or 3 and can be identical or different, provided that the sum of o+p is not greater than 4. The phthalocyanine compounds preferably contain a water-solubilising group, for example a sulfo group, and an $M_1$—N(R)—X group, in which R is hydrogen or alkyl and X is as defined for formula (25).

10. Nitro dyes of formula

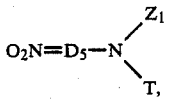

(35)

wherein D is a naphthalene nucleus or benzene nucleus which can be further substituted, the nitrogen atom N is in the o-position to the nitro group, $Z_1$ is hydrogen or a substituted or unsubstituted hydrocarbon radical and T is hydrogen or an organic radical which is bonded to the nitrogen through a carbon atom, and in which T and $Z_1$ are not both hydrogen atoms, or T can be bonded to $Z_1$ if $Z_1$ is a hydrocarbon radical or to $D_5$ in ortho-position to the nitrogen atom N, in each case to form a heterocyclic ring, and which contain at least one radical X, in particular an —N(R)—X radical, in which R is hydrogen or alkyl and X is as defined for the formula (25); in particular nitro dyes of formula $$NO_2—V_1—NH—B—N(R)—X \quad (36)$$

wherein $V_1$ and b are monocyclic aryl nuclei and the nitro group in $V_1$ is in the o-position to the —NH group.

11. Metal complexes of formazan dyes of formula

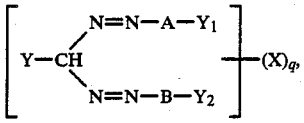

(37)

wherein Y is an organic radical or a nitro or cyano group, A and B are radicals of diazo components of the benzene, naphthalene or heterocyclic series, and each of $Y_1$ and $Y_2$ is a substituent which is bonded in the o-position to the azo group and is able to form a complex with a heavy metal, X is as defined for formula (25), and q is 1 or 2.

The radical Y is in particular a radical of the benzene series, for example phenyl or sulfophenyl, or an alkyl radical, for example methyl, a low molecular alkanoyl group, for example acetyl, a carbalkoxy group having up to 4 carbon atoms, a benzoyl group or a heterocyclic radical, and A and B are preferably phenyl radicals, which are substituted by sulfo, sulfamoyl or alkylsulfonyl groups. $Y_1$ and $Y_2$ are preferably —OH and —COOH groups. Suitable heavy metals are copper, chromium, cobalt and nickel.

12. Dioxazines of formula

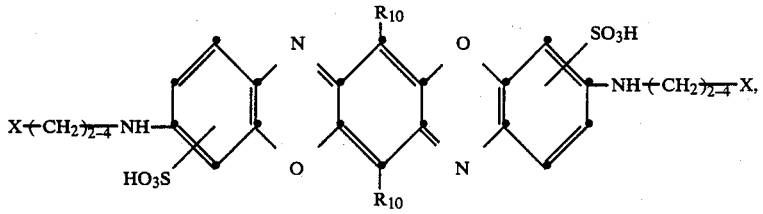

(38)

wherein $R_{10}$ is $C_1$–$C_4$alkyl, e.g. methyl, or halogen, e.g. chlorine, and X is as defined for the formula (25).

Preferred embodiments of the process of this invention comprise:

(a) using at least 2 or 3 reactive dyes of formula (25), (b) for trichromatic dyeing, using at least one reactive dye that gives a yellow or orange dyeing, at least one reactive dye that gives a red dyeing, and at least one reactive dye that gives a blue dying, (c) dyeing pure cellulosic fibres, (d) dyeing polyester/cellulose blends, (e) dyeing continuously, (f) dyeing pure cellulose fibres with reactive dyes and fixing the dyeing so obtained with steam for 30 seconds to 12 minutes in the temperature range from 100° to 150° C., (g) rinsing the fixed dyeings with hot and/or cold water, in the absence or presence of a detergent.

The dye liquor can also contain alkalies for fixing the reactive dyes, for example sodium carbonate, sodium bicarbonate, sodium hydroxide, disodium phosphate, trisodium phosphate, borax, aqueous ammonia or alkali donors, e.g. sodium trichloroacetate. A very suitable alkali is in particular a mixture of water glass and a 30% aqueous solution of sodium hydroxide. The pH of the alkaline dye liquors is normally in the range from 7.5 to 13.2, preferably from 8.5 to 11.5.

The padding liquors are conveniently prepared by dissolving the dye and adding the water-soluble anionic, colourless, organic compound and alkali.

Depending on the dye employed, the dye liquours can contain conventional additives, e.g. electrolytes such as sodium chloride or sodium sulfate, as well as urea, glycerol and/or sodium formate. If desired, thickeners such as alginates, starch ethers or locust bean gum can also be added to the dye liquors.

Besides the graft polymers, it is often advantageous to add commercially available alkali-resistant wetting agents to the padding liquors, e.g. sulfonated polycarboxylic acid esters such as dihexylsulfosuccinates or dioctylsulfosuccinates; alkylarylsulfonates with linear or branched alkyl chain containing at least 6 carbon atoms, e.g. dodecylbenzenesulfonates, or preferably alkylsulfonates containing 8 to 20 carbon atoms in the alkyl chain, e.g. dodecylsulfonates or pentadecylsulfonates. The sulfonates suitable for use as wetting agents are usually in the form of alkali metal salts, preferably of sodium salts or also of ammonium salts.

The amounts in which the wetting agents are added to the padding liquors preferably vary from 1 to 10 g/l, preferably from 0.5 to 3 g/l.

Dye fixation on pure cellulose fibres is effected by conventional methods, the fixing time and temperature being contingent on the fibre material and, if reactive dyes are used, on the reactivity of the dyes employed. In general, steaming times in saturated steam of 30 seconds to 15 minutes at 100° to 105° C. suffice to obtain a level and optimum dye fixation. In high temperature steaming and dry heat steaming, fixation is carried out for 20 seconds to 8 minutes at 105°–190° C. It is preferred to fix the reactive dyes with steam for 30 seconds to 12 minutes in the temperature range from 100° to 150° C. Dyes comprising at least one reactive dye are fixed in the temperature range from 100° to 200° C. on blends such as polyester/cellulose blends, with the fixing time being preferably from 10 seconds to 10 minutes at preferably 150°–200° C. If desired, the textile material is dried before fixation.

Fixation can also be made by the cold pad-batch process, for example at room temperature for 6 to 12 hours dwell time.

Following the dyeing process, the dyed cellulosic material can be given a washing off in conventional manner to remove non-fixed dye. This is done by treating the substrate, e.g. at 40° C. to boiling temperature, in a solution which contains soap or a synthetic detergent. Treatment with a fixing agent can subsequently be effected to improve the wetfastness properties.

The dyes are finished by rinsing in hot and/or cold water and by an optional wash in the presence of a commercially available detergent, followed by rinsing in water and drying.

Suitable cellulosic fibres are natural fibres, such as mercerised or bleached cotton and linen (bleached), and regenerated fibres such as viscose fibres, polynosic fibres and cuprammonium rayon fibres. Woven or knitted goods made from these fibres are mainly used.

The invention is illustrated by the following Examples, in which parts and percentages are by weight. The relationship between parts by weight and parts by volume is the same as that between the gram and the cubic centimeter. The indicated amounts of dye refer to commercially available dye.

EXAMPLE 1

Bleached cotton cretonne is impregnated on a pad to a pick-up of 70% with a padding liquor of the following composition: 0.62 g/l of the orange dye of formula

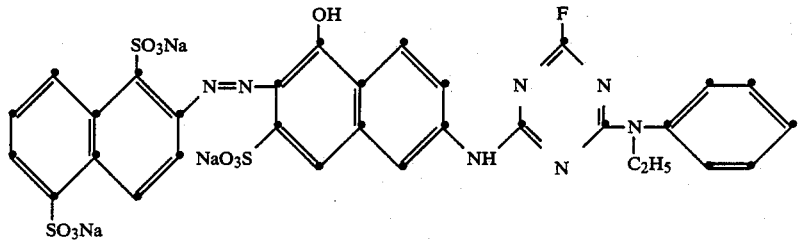

(101)

10 g/l of calcined sodium sulfate, 1 g/l of a wetting agent, and 7.5 g/l of the compound of formula

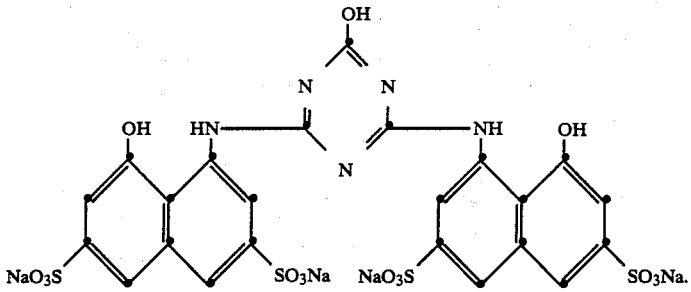

(201)

The immersion time is 2 seconds. The affinity factor $B_1$ of the above dye in the padding liquor is 1.05.

The affinity factor is determined by spectrophotometry (UVICON 810), with the concentration of the padding liquor being determined before impregnation and that of the residual liquor after impregnation. The spectrophotometric measurement is made at the absorption maximum of the dye ($\lambda_{maX}$=486 nm).

The affinity factor is defined as:

$$\text{affinity factor} = \frac{\text{concentration of dye in the original liquor (before impregnation)}}{\text{concentration of dye in the residual liquor (after impregnation)}}$$

The affinity factor is a critical value for tailing caused by differences in substantivity of the dyes. No tailing can be observed at a value of c. 0.95 to 1.05, close to the ideal affinity factor of 1.0.

The indicated amount of water-soluble, colourless organic compound and the values for the affinity factor A refer to commercially pure substances having an active substance content of at least 70%.

The affinity factor of the compound of formula (201) is determined as follows: Mercerised cotton fabric is impregnated with a liquor containing 10 g/l of $Na_2SO_4$ and 0.3 g/l of the compound of formula (201). The affinity factor is determined spectrophotometrically (UVICON 810), with the concentration of dye in the liquor being measured before impregnation and that of the residual liquor after impregnation (liquor pick-up: 70%). The spectrophotometric measurement is made at $\lambda_{max}$=352 nm. The affinity factor $A_1$ is 1.35.

After padding, the cotton cretonne fabric is dried for 1 minute at 100° C., padded with a liquor containing 250 g/l of NaCl and 10 ml/l of 30% NaOH to a pick-up of c. 80%, and then fixed for 1 minute in saturated steam at 101° to 103° C.

The cotton cretonne fabric is first rinsed with cold water and with hot to boiling water, soaped at the boil in 1 to 2 g/l of a detergent, rinsed again with hot and then with cold water, and subsequently dried.

The cotton cretonne fabric is dyed end-to-end in an orange shade of good fastness properties.

COMPARISON EXAMPLE 1

The procedure of Example 1 is repeated, using a padding liquor that does not contain the compound of formula (201). The orange dyeing exhibits tailing, with the beginning of the cotton cretonne fabric being dyed in a darker shade than the end of the batch, as the residual padding liquor is impoverished and thus diluted. The affinity factor of the orange dye of Example 1 in the padding liquor without the addition of the compound of formula (201) is 1.23.

EXAMPLE 2

Bleached mercerised cotton cretonne fabric is impregnated on a pad to a pick-up of 70% with a padding liquor of the following composition:

0.675 g/l of the red dye of formula

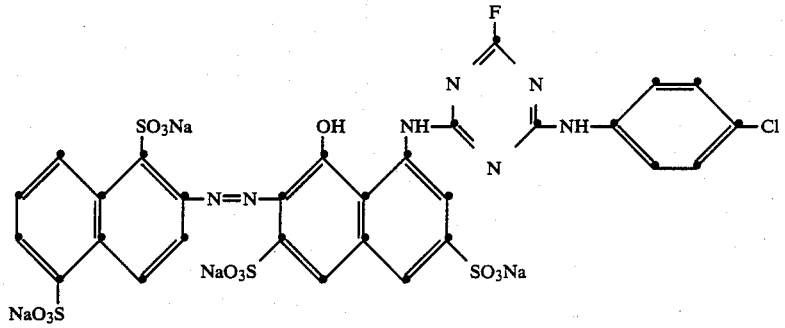

(102)

50 g/l of urea
20 g/l of sodium bicarbonate,
1 g/l of a wetting agent, and
7.2 g/l of the compound of formula

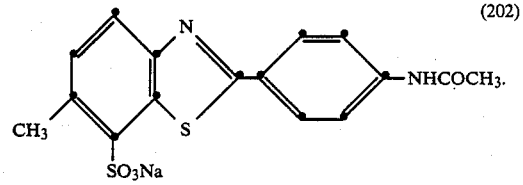

(202)

The immersion time is 2 seconds. The affinity factor of the above dye in the padding liquor is 1.04, determined according to the particulars of Example 1 at $\lambda_{max}$=550 nm.

The affinity factor of the compound of formula (202) is 1.54, determined under the standard conditions de-

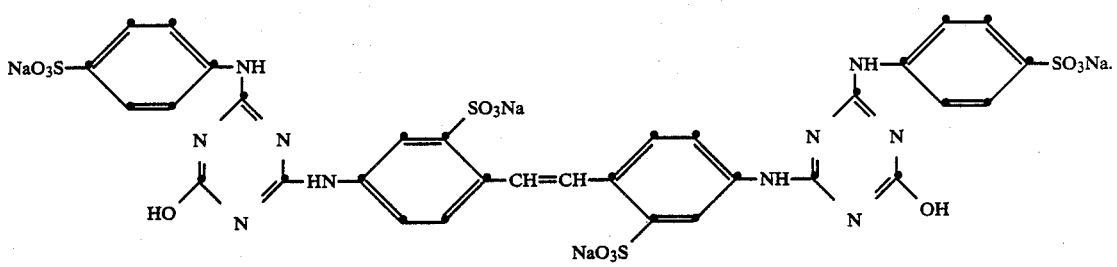

scribed in Example 1 at $\lambda_{max}$ 328 nm.

The padded fabric is then dried for 1 minute at 100° C. in a hot flue and subsequently heat set for 1 minute at 160° C. in a hot flue.

The cotton cretonne fabric is rinsed, soaped, rinsed again and dried as described in Example 1. It is dyed end-to-end in a red shade of good fastness properties.

COMPARISON EXAMPLE 2

The procedure of Example 2 is repeated, using a padding liquor that does not contain the compound of formula (202). The red dyeing exhibits tailing, with the beginning of the cotton cretonne fabric being dyed in a markedly darker shade than the end of the batch. The affinity factor of the red dye of Example 2 in the padding liquor without the addition of the compound of formula (202) is 1.21, determined in accordance with the particulars of Example 1.

EXAMPLE 3

Caustified viscose rayon cretonne is impregnated on a pad to a pick-up of 82% with a liquor of the following composition:

0.5 g/l of the yellow dye of formula

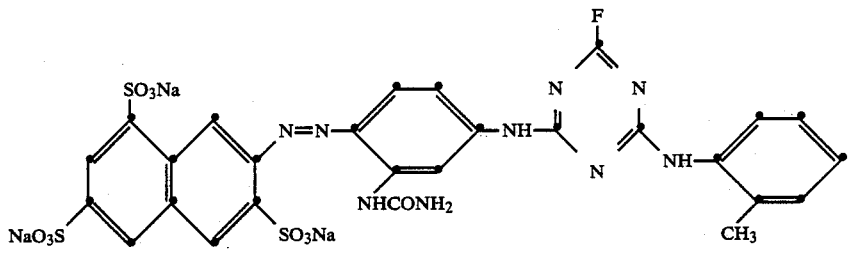

0.15 g/l of the red dye of formula (102),
0.12 g/l of the blue dye of formula

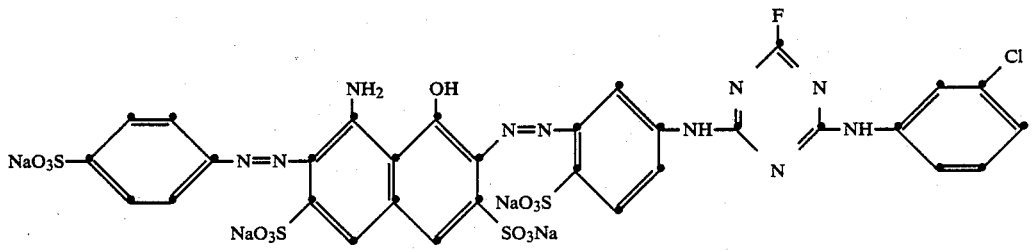

10 g/l of calcined sodium sulfate,
10 g/l of sodium bicarbonate,
50 g/l of urea,
1 g/l of a wetting agent, and
7 g/l of the compound of formula The immersion time is 4 seconds. The affinity factors of the above dyes in the padding liquor are
yellow dye: 1.02 at $\lambda_{max}$=425 nm
red dye: 0.99 at $\lambda_{max}$=550 nm
blue dye: 1.00 at $\lambda_{max}$=600 nm
determined in accordance with the particulars of Example 1.

The affinity factor of the compound of formula (203) is 1.49 [$\lambda_{max}$=330 nm], determined according to Example 1.

After padding, the viscose rayon fabric is steamed for 1 minute with saturated steam at 101°-103° C., then rinsed, soaped, rinsed once more and dried.

The viscose rayon cretonne is dyed end-to-end in a beige shade of good fastness properties.

COMPARISON EXAMPLE 3

The procedure of Example 3 is repeated, using a padding liquor that does not contain the compound of formula (203). The beige dyeing obtained exhibits tailing. The affinity factors of the dyes used in the padding liquor without the addition of the compound of formula (203) are:
yellow dye: 1.13 at $\lambda_{max}$=425 nm
red dye: 1.11 at $\lambda_{max}$=550 nm
blue dye: 1.19 at $\lambda_{max}$=600 nm
determined in accordance with the particulars of Example 1.

EXAMPLE 4

Bleached mercerised cotton fabric is impregnated on a pad to a liquor pick-up of 70% with a liquor of the following composition:

0.6 g/l of the blue dye of formula

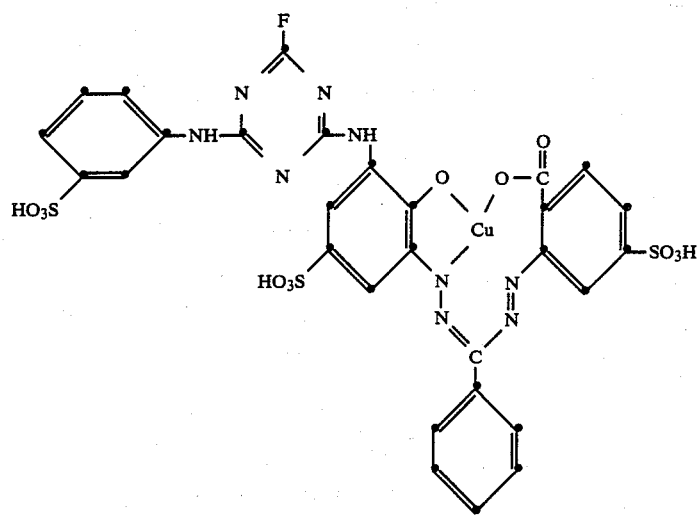

(105)

10 g/l of sodium chloride, 1 g/l of a wetting agent, 2 g/l of an antioxidant (sodium m-nitrobenzenesulfonate), 7.5 g/l of the compound of formula

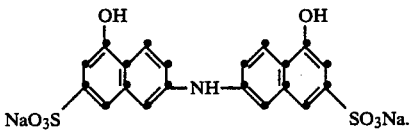

(204)

The immersion time is 2 seconds. The affinity factor of the above dye in the padding liquor is 1.02, determined in accordance with the particulars of Example 1 at $\lambda_{max}=625$ nm.

The affinity factor of the compound of formula (204) is 1.72 [$\lambda_{max}=276$ nm], determined in accordance with the particulars of Example 1.

After padding, the cotton fabric is dried for 1 minute on a hot flue, padded with a liquor containing 250 g/l of NaCl and 10 ml/l of 30% NaOH to a pick-up of c. 80%, and then steamed with saturated steam for 1 minute at 101°-103° C. The fabric is then rinsed, soaped, rinsed once more and dried as described in Example 1.

The cotton fabric is dyed end-to-end in a blue shade of good fastness properties.

COMPARISON EXAMPLE 4/1

The procedure of Example 4 is repeated, using a padding liquor that does not contain the compound of formula (204). The cotton is dyed in a blue shade that exhibits tailing. The affinity factor of the dye used in the padding liquor is 1.40 without the addition of the compound of formula (204).

COMPARISION EXAMPLE 4/2

The procedure of Example 4 is repeated using 0.3 g/l of the dye of formula (105) and 3 g/l of the compound of formula

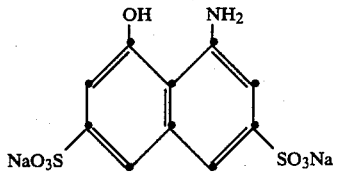

(H—acid)

instead of 7.5 g/l of the compound of formula (204). The immersin time is 4 seconds. The affinity factor of the above dye used in the padding liquor under these conditions is 1.86 [$\lambda_{max}=625$ nm]. An affinity factor of 1.90 [$\lambda_{max}=625$ nm] is obtained by using a padding liquor without the addition of H-acid.

The affinity factor of H-acid in a padding liquor containing 10 g/l of NaCl and 0.3 g/l of H-acid is 1.00.

The addition to the padding liquor of a colourless, water-soluble organic compound having an affinity factor of 1.0 has no influence on the affinity factor of the dye employed and tailing is therefore not improved.

EXAMPLE 5

A bleached mercerised cotton cretonne fabric is impregnated on a pad to a pick-up of 70% with a liquor of the following composition:

0.75 g/l of the blue dye of formula

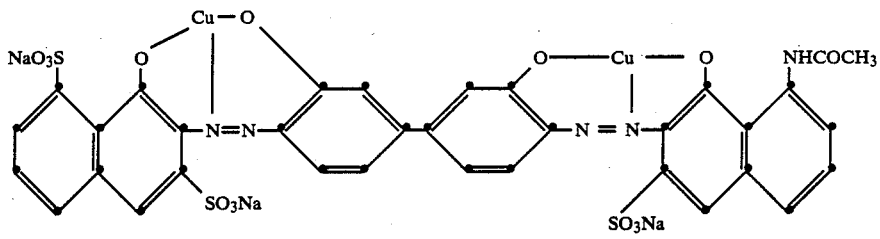

(106)

1 g/l of a wetting agent, and
7 g/l of the compound of formula (205)

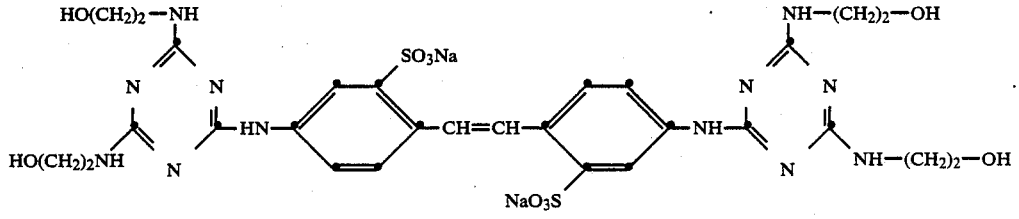

(206)

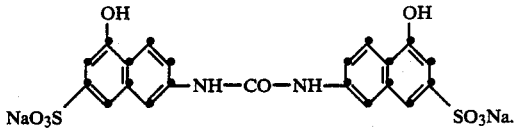

The immersion time is 2 seconds. The affinity factor of the dye is 1.0 (determined in accordance with Example 1 at $\lambda_{max}=586$ nm). The speed of the goods is 10 m/min. The fabric is then fixed with saturated steam of 101°-103° C. for 2 minutes in a continuous steamer. The fabric is thereafter repeatedly rinsed and dried. The affinity factor of the compound of formula (205) is 2.0 [$\lambda_{max}=370$ nm), determined in accordance with Example 1. The fabric is dyed in a continuous blue shade of good fastness properties.

COMPARISON EXAMPLE 5

The procedure of Example 5 is repeated, using a padding liquor without the addition of the compound of formula (205). The fabric is dyed in a blue shade that exhibits tailing. The affinity factor of the dye without the addition of the compound of formula (205) to the padding liquor is 1.11.

EXAMPLE 6

A polyester/cotton blend containing 67% by weight of polyester is impregnated on a pad to a pick-up of 47% with a liquor of the following composition:
1.25 g/l of the yellow dye of formula
20 g/l of sodium carbonate,
50 g/l of urea,
1 g/l of a wetting agent, and
7 g/l of the compound of formula The immersion time is 2 seconds. The affinity factor of the dye used in the padding liquor is 1.04 [$\lambda_{max}=420$ nm).

The affinity factor of the compound of formula (206) is 1.39 [$\lambda_{max}=347$], determined in accordance with Example 1.

The polyester/cotton fabric is dried for 1 minute at 100° C. and then subjected to a thermosol treatment at 210° C. The fabric is washed, soaped, rinsed once more and dried in accordance with Example 2. An end-to-end yellow dyeing is obtained.

COMPARISON EXAMPLE 6

The procedure of Example 6 is repeated, using a padding liquor without the addition of the compound of formula (206). The polyester/cotton fabric is dyed in a yellow shade that exhibits tailing. The affinity factor of the dye is 1.24 without the addition of the compound of formula (206) to the padding liquor.

EXAMPLE 7

Bleached mercerised cotton tricot is impregnated on a pad to a pick-up of 95% with a liquor of the following composition:
0.425 g/l of the yellow dye of formula (103),
0.35 g/l of the blue dye of formula (105),
50 ml/l of 30% sodium silicate,
2 ml/l of 30% NaOH,
1 g/l of wetting agent, and (107)

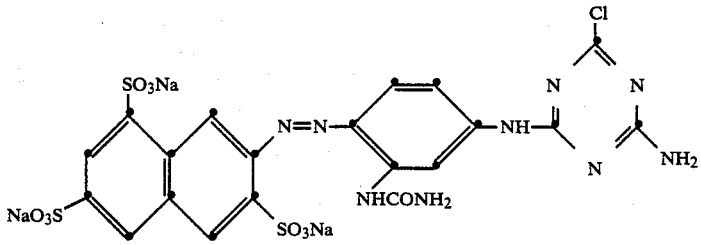

7 g/l of the compound of formula (207)

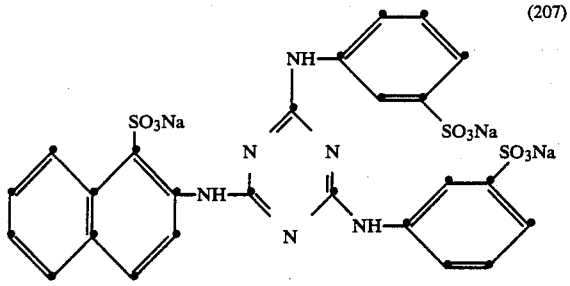

The immersion time is 2 seconds. The affinity factor of the dyes in the above padding liquor is
yellow dye: 1.05 $\lambda_{max}$: 425 nm
blue dye: 1.07 $\lambda_{max}$: 625 nm The affinity factor of the compound of formula (207) is 1.47 [$\lambda_{max}$=275 nm), determined according to Example 1.

The cotton tricot is subsequently stored for 6 hours at room temperature with the exclusion of air.

The fabric is dyed end-to-end in a green shade of good fastness properties.

COMPARISON EXAMPLE 7

The procedure of Example 7 is repeated, using a padding liquor without the addition of the compound of formula (207). The tricot is dyed in a green shade that exhibits tailing. The affinity factor without the addition of the compound of formula (207) to the padding liquor is:
yellow dye: 1.19 $\lambda_{max}$=425 nm
blue dye: 1.25 $\lambda_{max}$=625 nm.

End-to-end dyeings are also obtained by repeating the procedures described in Examples 1 to 7, but using instead of the compounds of formula (201) to (207) an equimolar amount of one of the compounds of formula (13), (14), (16), (17) or (18) in the form of the sodium salt or of a melamine compound of formula (208)

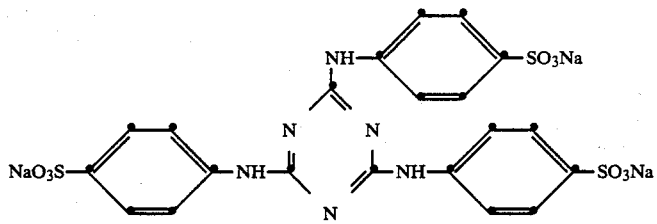

affinity factor: 1.252 ($\lambda_{max}$ 284)

(209)

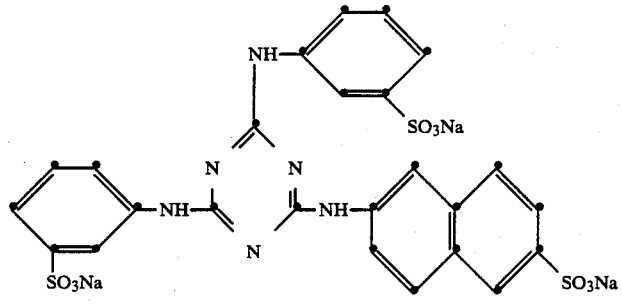

affinity factor: 1.539 ($\lambda_{max}$ 267)

(210)

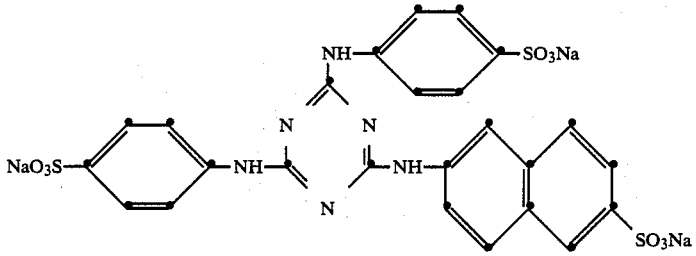

affinity factor: 1.570 ($\lambda_{max}$ 270)

-continued (211)

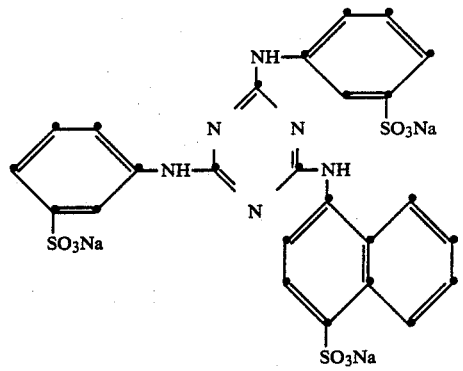

affinity factor: 1.176 ($\lambda_{max}$ 268)

or (212)

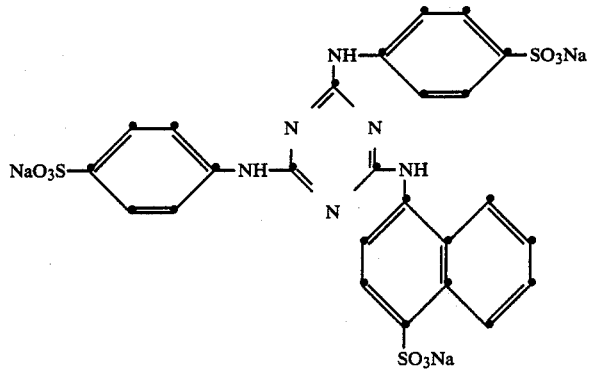

affinity factor: 1,191 ($\lambda_{max}$ 286)

What is claimed is:

1. A process for the uniform end-to-end dyeing of dyeing of cellulosic materials, or blends that contain cellulose, with direct or reactive dyes by the pad dyeing process, which comprises treating said cellulosic materials or blends with an aqueous liquor that contains at least one water-soluble direct or reactive dye and an effective amount of at least one water-soluble anionic colourless organic compound containing a carboxy or sulfonic acid group and having an affinity factor A, at a concentration of 0.2 to 0.3 g/l, for mercerised cotton of 1.1 to 4, said factor A being the quotient of the concentration of the water-soluble, colourless organic compound in a liquor without addition of dye, before impregnation, divided by the concentration of the water-soluble, colourless organic compound in the liquor without dye after impregnation.

2. A process according to claim 1 wherein the direct or reactive dye has an affinity factor B for mercerised cotton, at a concentration of 0.1 gram per liter, of at least 1.1, said factor B being the quotient of the concentration of dye in a dyeing liquor without addition of the colourless organic compound divided by the concentration of dye in the residual liquor without the colourless organic compound after impregnation.

3. A process according to claim 1 wherein the maximum concentration of dye, together with the anionic water-soluble, colourless organic compound in the aqueous liquor is 20 grams per liter.

4. A process according to claim 3, wherein the maximum concentration of dye and of colourless compound together is 10 grams per liter.

5. A process according to claim 4, wherein the concentration of dye and of colourless compound together is 3 to 8 grams per liter.

6. A process according to claim 1, wherein the concentration of dye is less than 5 grams per liter.

7. A process according to claim 1, wherein the water-soluble, colourless, anionic organic compound has an affinity factor A of 1.15 to 2.5.

8. A process according to claim 7, wherein the water-soluble colourless compound has an affinity factor A of 1.2 to 1.6.

9. A process according to claim 1 wherein the direct or reactive dye and the anionic, colourless organic compound are so chosen as to provide a dyeing liquor wherein the apparent affinity factor B of the dye in the mixture is 0.9 to 1.15, said factor B being the quotient of the concentration of dye in the dyeing mixture before impregnation divided by the concentration of dye in the residual dyeing mixture after impregnation.

10. A process according to claim 1, wherein the colourless organic compound is (a) a compound of formula (1)

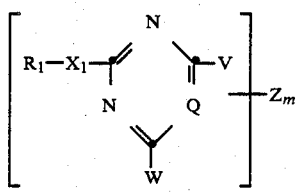

wherein

Q is $=CH-R_x$ or $=N-$, $R_x$ is hydrogen, halogen, cyano, $C_1$–$C_4$alkyl or $C_1$–$C_4$alkylsulfonyl, V and W are each independently of the other $R_2$—$X_2$—, $R_3$—$X_3$—, hydroxy, $C_1$–$C_4$alkoxy, an unsubstituted amino group or an amino group which is substituted by one or two $C_1$–$C_4$alkyl radicals which are in turn unsubstituted or substituted by hydroxy, cyano, sulfo or sulfato, $R_1$, $R_2$ and $R_3$ are each independently an aromatic or heteroaromatic radical, $X_1$, $X_2$ and $X_3$ are each independently —O—, —S—,

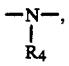

or —NH—CO—Phen—NH—, $R_4$ is hydrogen, $C_1$–$C_4$alkyl or phenyl,

Phen is an unsubstituted or substituted phenylene group,

Z is an acid water-solubilising group, and m is an integer from 1 to 6; or (b) a compound of formula $$[R_1\text{—NH—A—}R_2]Z_m \quad (2)$$

wherein $R_1$, $R_2$, Z and m have the given meanings,

A is a direct bond, —CO—, —CONH— or

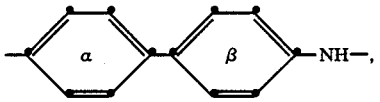

and the rings α and β are unsubstituted or substituted; or (c) a compound of formula

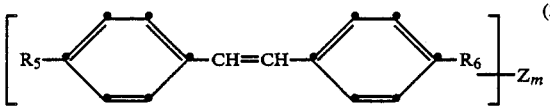

(3)

wherein $R_5$ and $R_6$ are each independently of the other

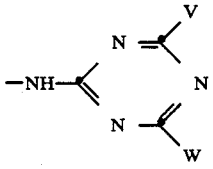

(3a)

$R_7$ is $C_1$–$C_8$alkyl or aryl, and

V, W, Z and m have the given meanings; or (d) a compound of formula

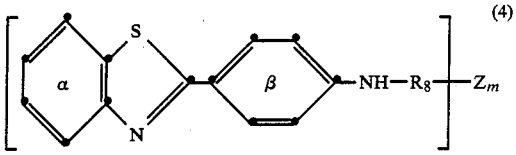

(4)

wherein $R_8$ is hydrogen or $R_9$—CO—, $R_9$ is an aliphatic, aromatic or heterocyclic radical, the rings α and β are unsubstituted or substituted and Z and m have the given meanings.

11. A process according to claim 10, wherein in the compound of formula (1) Q is —N=.

12. A process according to claim 10, wherein in the compound of formula (1) V is $R_2$—$X_2$ and W is $R_3$—$X_3$.

13. A process according to claim 10, wherein in the compound of formula (1) $X_1$, $X_2$ and $X_3$ are each —NH—.

14. A process according to claim 10, wherein in the compound of formula (1) $R_1$, $R_2$ and $R_3$ are each an aryl radical.

15. A process according to claim 10, wherein in the compound of formula (1) V is hydroxyl and W is $R_3$—$X_3$.

16. A process according to claim 10, wherein m is 1 to 4.

17. A process according to claim 10, wherein Z is the sulfonic acid group.

18. A process according to claim 10, wherein the colourless organic compound is a compound of the formula

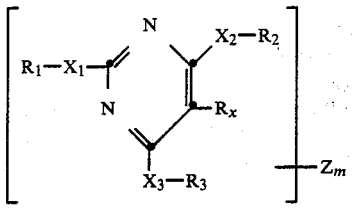

(5)

wherein $R_x$ is hydrogen, halogen, cyano, $C_1$–$C_4$-alkyl or $C_1$–$C_4$-alkylsulfonyl, $R_1$, $R_2$ and $R_3$ are each independently a phenyl, biphenylyl, naphthyl, stilbenyl or quinolinyl radical, each unsubstituted or substituted by $C_1$–$C_4$alkyl, halogen, trifluoromethyl, nitro, cyano, hydroxy, $C_1$–$C_4$alkoxy, amino, mono($C_1$–$C_4$)alkylamino, di($C_1$–$C_4$)alkylamino, phenylamino, $C_1$–$C_7$acylamino, carbamoyl, ureido, sulfamoyl, $C_1$–$C_4$alkoxycarbonyl, $C_1$–$C_4$alkylsulfonyl or sulfomethyl, $X_1$, $X_2$ and $X_3$ are each independently —O—, —S—,

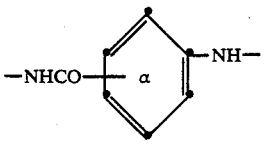

and $R_4$ is hydrogen, $C_1$–$C_4$alkyl or phenyl,

Z is a carboxyl group or a sulfonic acid group, m is 2 to 6, and the benzene ring α is unsubstituted or substituted by one or more substituents as indicated for $R_1$.

19. A process according to claim 10, wherein the colourless organic compound is one of the formula

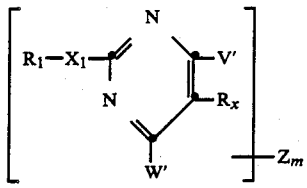

(6)

wherein $R_x$ is hydrogen, halogen, cyano, $C_1$–$C_4$-alkyl or $C_1$–$C_4$-alkylsulfonyl, V′ and W′ are each independently of the other hydroxy, $C_1$–$C_4$alkoxy, or an unsubstituted amino group or an amino group which is substituted by one or two $C_1$–$C_4$alkyl radicals which are in turn unsubstituted or substituted by hydroxy, cyano, sulfo or sulfato, and V′ is also the radical $R_2$—$X_2$—, $R_1$ and $R_2$ are each independently a phenyl, biphenylyl, naphthyl, stilbenyl or quinolinyl radical, each unsubstituted or substituted by $C_1$–$C_4$alkyl, halogen, trifluoromethyl, nitro, cyano, hydroxy, $C_1$–$C_4$alkoxy, amino, mono($C_1$–$C_4$)alkylamino, di($C_1$–$C_4$)alkylamino, phenylamino, $C_1$–$C_7$acylamino, carbamoyl, ureido, sulfamoyl, $C_1$–$C_4$alkoxycarbonyl, $C_1$–$C_4$alkylsulfonyl or sulfomethyl, $X_1$ and $X_2$ are each independently —O—, —S—,

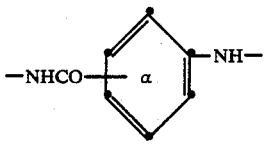

wherein $R_4$ is hydrogen, $C_1$–$C_4$alkyl or phenyl and the benzene ring α is unsubstituted or substituted by one or more substituents as indicated for $R_1$, Z is a carboxyl group or a sulfonic acid group, and m is 2 to 4.

20. A process according to claim 10, wherein the colourless organic compound is a compound of the formula

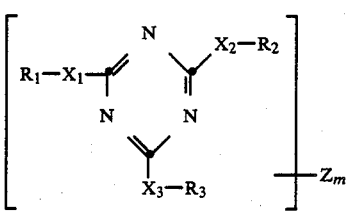

(7)

wherein $R_1$, $R_2$ and $R_3$ are each independently a phenyl, biphenylyl, naphthyl, stilbenyl or quinolinyl radical, each unsubstituted or substituted by $C_1$–$C_4$alkyl, halogen, trifluoromethyl, nitro, cyano, hydroxy, $C_1$–$C_4$alkoxy, amino, mono($C_1$–$C_4$)alkylamino, di($C_1$–$C_4$)alkylamino, phenylamino, $C_1$–$C_7$acylamino, carbamoyl, ureido, sulfamoyl, $C_1$–$C_4$alkoxycarbonyl, $C_1$–$C_4$alkylsulfonyl or sulfomethyl, $X_1$, $X_2$ and $X_3$ are each independently —O—, —S—,

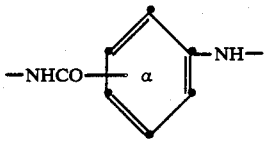

wherein $R_4$ is hydrogen, $C_1$–$C_4$alkyl or phenyl and the benzene ring α is unsubstituted or substituted by one or more substituents as indicated for $R_1$, Z is a carboxyl group or a sulfonic acid group, and m is 2 to 6.

21. A process according to claim 20, wherein in the triazine compound of formula (7) $X_1$, $X_2$ and $X_3$ are each independently —NH—, $R_1$, $R_2$, $R_3$ are each independently phenyl or naphthyl, Z is a sulfonic acid group and m is 2 or 3.

22. A process according to claim 10, wherein the colourless organic compound is a compound of the formula

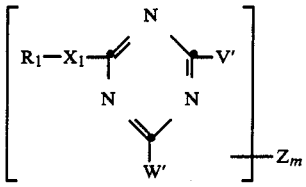

(8)

wherein

V′ and W′ are each independently of the other hydroxy, $C_1$–$C_4$alkoxy, or an unsubstituted amino group or an amino group which is substituted by one or two $C_1$–$C_4$alkyl radicals which are in turn unsubstituted or substituted by hydroxy, cyano, sulfo or sulfato, and V′ is also the radical $R_2$—$X_2$—, $R_1$ and $R_2$ are each independently a phenyl, biphenylyl, naphthyl, stilbenyl or quinolinyl radical, each unsubstituted or substituted by $C_1$–$C_4$alkyl, halogen, trifluoromethyl, nitro, cyano, hydroxy, $C_1$–$C_4$alkoxy, amino, mono($C_1$–$C_4$)alkylamino, di($C_1$–$C_4$)alkylamino, phenylamino, $C_1$–$C_7$acylamino, carbamoyl, ureido, sulfamoyl, $C_1$–$C_4$alkoxycarbonyl, $C_1$–$C_4$alkylsulfonyl or sulfomethyl, $X_1$ and $X_2$ are each independently —O—, —S—,

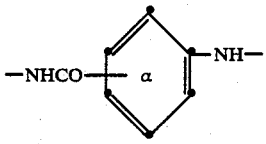

and $R_4$ is hydrogen, $C_1$–$C_4$alkyl or phenyl,

Z is a carboxyl group or a sulfonic acid group, m is 2 to 4 and the benzene ring α is unsubstituted or substituted by one or more substituents as indicated for $R_1$.

23. A process according to claim 10, wherein the colourless organic compound is a compound of the formula $$\left[R_1-NH-R_2\right]_{Z_m} \quad (9)$$

wherein $R_1$ and $R_2$ are each independently a phenyl, biphenylyl, naphthyl, stilbenyl or quinolinyl radical, each unsubstituted or substituted by $C_1$–$C_4$alkyl, halogen, trifluoromethyl, nitro, cyano, hydroxy, $C_1$–$C_4$alkoxy, amino, mono($C_1$–$C_4$)alkylamino, di($C_1$–$C_4$)alkylamino, phenylamino, $C_1$–$C_7$acylamino, carbamoyl, ureido, sulfamoyl, $C_1$–$C_4$alkoxycarbonyl, $C_1$–$C_4$alkylsulfonyl or sulfomethyl, Z is a carboxyl group or a sulfonic acid group, and m is 2 to 4.

24. A process according to claim 10, wherein the colourless organic compound is a compound of the formula $$\left[R_1-NH-CO-R_2\right]_{Z_m} \quad (10)$$

wherein $R_1$ and $R_2$ are each independently a phenyl, biphenylyl, naphthyl, stilbenyl or quinolinyl radical, each unsubstituted or substituted by $C_1$–$C_4$alkyl, halogen, trifluoromethyl, nitro, cyano, hydroxy, $C_1$–$C_4$alkoxy, amino, mono($C_1$–$C_4$)alkylamino, di($C_1$–$C_4$)alkylamino, phenylamino, $C_1$–$C_7$acylamino, carbamoyl, ureido, sulfamoyl, $C_1$–$C_4$alkoxycarbonyl, $C_1$–$C_4$alkylsulfonyl or sulfomethyl, Z is a carboxyl group or a sulfonic acid group, and m is 2 to 4.

25. A process according to claim 10, wherein the colourless organic compound is a compound of the formula $$\left[R_1-NH-CO-NH-R_2\right]_{Z_m} \quad (11)$$

wherein $R_1$ and $R_2$ are each independently a phenyl, biphenylyl, naphthyl, stilbenyl or quinolinyl radical, each unsubstituted or substituted by $C_1$–$C_4$alkyl, halogen, trifluoromethyl, nitro, cyano, hydroxy, $C_1$–$C_4$alkoxy, amino mono($C_1$–$C_4$)alkylamino, di($C_1$–$C_4$)alkylamino, phenylamino, $C_1$–$C_7$acylamino, carbamoyl, ureido, sulfamoyl, $C_1$–$C_4$alkoxycarbonyl, $C_1$–$C_4$alkylsulfonyl or sulfomethyl, Z is a carboxyl group or a sulfonic acid group, and m is 2 to 4.

26. A process according to claim 10, wherein the colourless organic compound is a compound of the formula

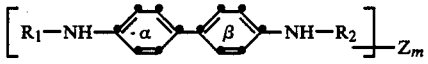

(12)

wherein $R_1$ and $R_2$ are each independently a phenyl, biphenylyl, naphthyl, stilbenyl or quinolinyl radical, each unsubstituted or substituted by $C_1$–$C_4$alkyl, halogen, trifluoromethyl, nitro, cyano, hydroxy, $C_1$–$C_4$alkoxy, amino, mono($C_1$–$C_4$)alkylamino, di($C_1$–$C_4$)alkylamino, phenylamino, $C_1$–$C_7$acylamino, carbamoyl, ureido, sulfamoyl, $C_1$–$C_4$alkoxycarbonyl, $C_1$–$C_4$alkylsulfonyl or sulfomethyl, Z is a carboxyl group or a sulfonic acid group, m is 2 to 4, and the benzene rings α and β are unsubstituted or substituted by one or more substituents as indicated for $R_1$.

27. A process according to claim 1, which comprises the use of at least one water-soluble reactive dye of formula $$D-(X)_q \quad (25)$$

wherein D is the radical of an organic dye of the monoazo, polyazo, metal complex azo, anthraquinone, phthalocyanine, formazan, azomethine, nitroaryl, dioxazine, phenazine or stilbene series, X is a fibre-reactive radical of the aliphatic, aromatic or heterocyclic series which is attached to the radical D direct or through a bridge, and q is 1, 2, 3, 4, 5 or 6.

28. A process according to claim 27, which comprises the use of two or three reactive dyes of formula (25).

29. A process according to claim 28 for trichromatic dyeing, which comprises the use of at least one yellow or orange reactive dye, at least one red reactive dye and at least one blue reactive dye.

30. A process according to claim 27, wherein the water-soluble reactive dye is of formula $$\left[D-(X)_q\right]_{(SO_3^{\ominus}Ka)_n} \quad (26)$$

wherein D is the radical of a monoazo, disazo, metal complex azo, anthraquinone formazan or dioxazine dye, Ka is a cation, n is 1, 2, 3,4,5 or 6, and X and q are as defined for formula (25) in claim 27.

31. A process according to claim 30, wherein the water-soluble reactive dye is of formula (26), wherein X is a radical of formula

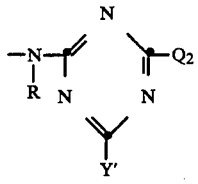

(27)

wherein R is hydrogen or $C_1$–$C_4$alkyl, $Q_2$ is an unsubstituted or substituted amino group, a difluorochloropyrimidinyl radical which is attached to the benzene ring through a phenylenediamine radical, or is a vinylsulfonyl, β-sulfatoethylsulfonyl, β-thiosulfatoethylsulfonyl, β-chloroethylsulfonyl or β-acetoxyethylsulfonyl radical which is attached to the benzene ring direct or through an aliphatic bridge, and Y' is fluorine or chlorine.

32. A process according to claim 1 for dyeing pure cellulose fibres.

33. A process according to claim 1 for dyeing polyester/cellulose blends.

34. A process according to claim 1, wherein dyeing is carried out continuously.

35. A process according to claim 1, which comprises dyeing cellulosic material with reactive dyes and fixing the dyeings with steam in the temperature range from 100° to 150° C. for 30 seconds to 12 minutes.

* * * * *